US006783341B1

(12) United States Patent
Taran

(10) Patent No.: US 6,783,341 B1
(45) Date of Patent: Aug. 31, 2004

(54) PAIR OF INTERACTING GEAR RIMS OF THE ROTARY MACHINE

(75) Inventor: David Taran, P.O. Box 9012, Tel-Aviv (IL), 61090

(73) Assignee: David Taran, Tel Aviv (IL)

( * ) Notice: Subject to any disclaimer, the term of this patent is extended or adjusted under 35 U.S.C. 154(b) by 0 days.

(21) Appl. No.: 10/069,997

(22) PCT Filed: Sep. 4, 2000

(86) PCT No.: PCT/IL00/00524

§ 371 (c)(1),
(2), (4) Date: Mar. 1, 2002

(87) PCT Pub. No.: WO01/18360

PCT Pub. Date: Mar. 15, 2001

(30) Foreign Application Priority Data

Sep. 5, 1999 (IL) ..... 131736

(51) Int. Cl.[7] ..... F01C 1/10
(52) U.S. Cl. ..... 418/171; 418/150
(58) Field of Search ..... 418/61.1, 150, 418/171

(56) References Cited

U.S. PATENT DOCUMENTS 1,277,437 A * 9/1918 Lind ..... 418/61.1
6,164,941 A * 12/2000 Kohsokabe et al. ..... 418/61.1

FOREIGN PATENT DOCUMENTS

| | | | | |
|---|---|---|---|---|
| DE | 2705256 | * | 8/1978 | ..... 418/171 |
| EP | 0894979 | * | 2/1999 | |
| WO | 94/08140 | * | 4/1994 | |

* cited by examiner

*Primary Examiner*—John J. Vrablik

(57) ABSTRACT

A pair of interacting gear rims of rotary machine has been invented as a basic structural element for engines, motors and compressors. This is the most simple and most effective design to predetermine the optimal ratio of volumes of expansion and compression processes only at the expense of the form of profile of contact surface of pair gear rims of the rotary machine. This is the ideal basic element for engines, working according to an extended indicator diagram, and for single stage compressor, working with multistage effect. Applications: light and heavy vehicle engines; space power systems; heat pump systems; solar, thermal, nuclear energy systems.

1 Claim, 6 Drawing Sheets

Figure 1:
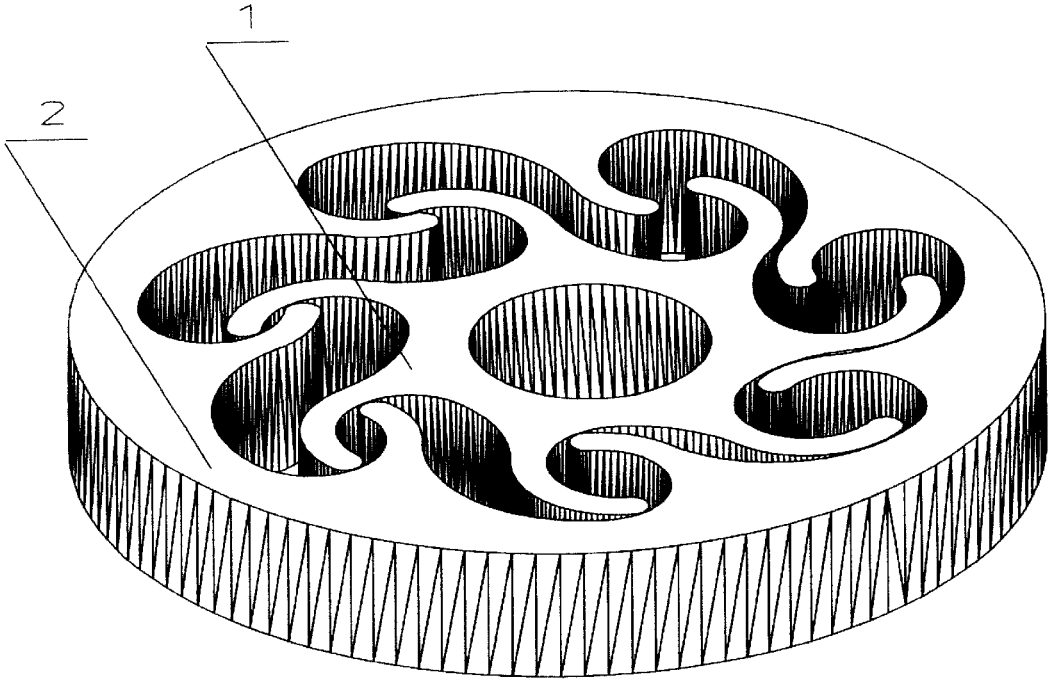

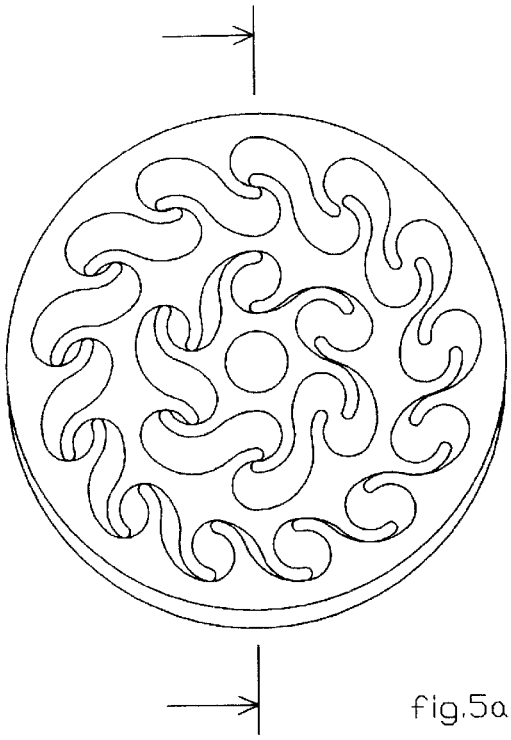
fig.5a
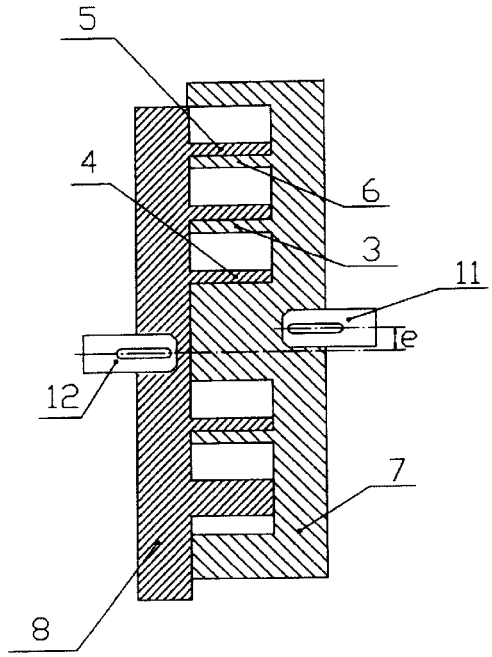
fig.5b
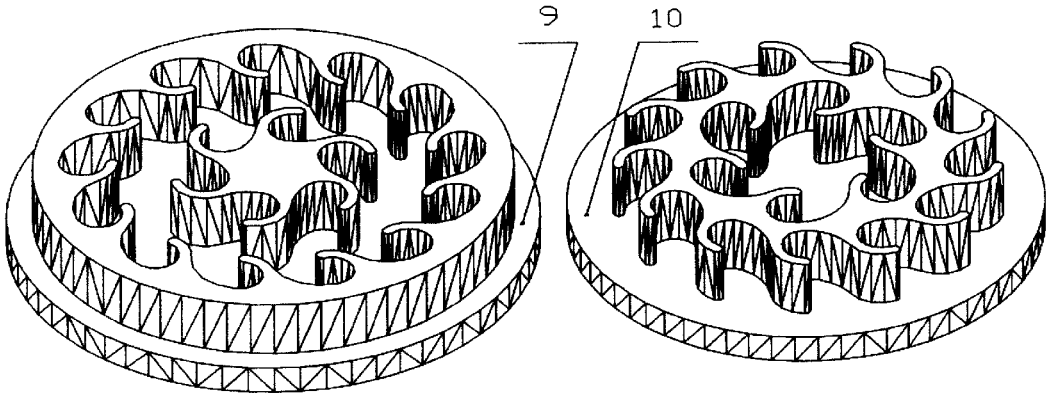
fig.5c
fig.5d

PAIR OF INTERACTING GEAR RIMS OF THE ROTARY MACHINE

BACKGROUND

1. Field of Invention

The invention concerns pair of gear rims—basic part of a design of rotary machines, in which the working process is carried out in chambers of variable volume formed as a result of interaction of pair eccentrically located gear rims, and can be used as in rotary machines with one rotor eccentrically located in static stator, and in rotary machines with several, in particular, with two, eccentrically located rotors. Declared pairs of gear rims can be used as a basic element of engines, pumps, compressors, hydro- and pneumatic motors, turbocompressors and other types of rotary machines.

2. Description of Prior Art

Known rotary machine "Rotary Power Device", was filed on Oct. 22, 1936 by Thomas M. Gunn, patent U.S. Pat. No. 2,112,890. In this rotary machine working chambers are created in between interacting working surfaces of a pair of gear rims, placed on the inner surface of the outer rotor and on the outer surface of the inner rotor. The rotors are placed with eccentricity, the value of which equals the difference of radiuses of interacting sections of surfaces of interacting gear rims on the outer and inner rotors respectively.

The profile of contact surface of inner and outer gear rims has an axis of symmetry, bounded by conjugated arcs and represents the closed smooth curve consisting of n>2 identical parts, conjugated among themselves. The identical part of contact surface of a gear rim is bounded by three conjugated arcs of a circle.

The machine contains inlet ports placed in end caps and discharge ports that are uniformly spaced with respect to the axis of rotation of spur wheel. Each of the discharge ports will move periodically into alignment with the exhaust passage opening through the circumference of the eccentric.

The existence of three conjugated arcs in identical part of the surface of gear rim in case of using discharge ports inside of inner rotor leads to serious loss of the yield and productivity of the machine. It is a result of the following feature of gear rim profiles that contains three arcs.

The chambers of variable volume are created in the area of conjugation of surfaces of different curvature. Abrupt change of the volume of created chamber is taking place in this area. If the port of slide-valve mechanism is placed in this area, on condition that this mechanism is functioning, while the port is wholly located within the chamber, then at the moment when the port is wholly located within the chamber, this chamber has a large volume that is totally lost for the working process, which lowers the yield and the productivity of the machine. For decreasing this volume it is possible to decrease the cross-section of the port, but it will cause an increased loss of energy, which means the decrease of yield of the machine.

More over during the creation of chambers the surfaces are increasing the most at the expanse of the surfaces with lower curvature. The lower the curvature radius of the surface of the inner rotor, the faster it opens at lower chamber volumes. In ideal case a flat surface totally opens at minimal chamber volume (although using flat surfaces leads to drastic loss of the productivity of the machine—patent EP 0 894 979 A1).

In the gear rim, identical part of which consists of three arcs, the arc of the smallest curvature is placed on the outer part of the inner rim, outside the point of identical part of the profile, that is nearest to the axes of the gear rim, in the optimal case (Patent WO 94/08140), it contains this point as the endpoint. Therefore slide-valve port has a sizable extraneous volume since it cannot be placed at a minimal distance from the axes of control gear, that is coincides with the axes of the gear rim. It leads to additional lowering of the yield and productivity of the rotary machine.

Patents similar to patent U.S. Pat. No. 2,112,890 are patents WO 94/08140 (JP 405202869A), EP 0 894 979 A1, JP 355023353A, JP 406280758A, all of them contain all the above mentioned drawbacks of gear rims with identical parts made of three conjugated arcs.

From the said above it follows, that it is impossible to create a gear rim with identical parts constructed from three conjugated arcs, that provide effective work of a control gear placed within the inner rotor.

SUMMARY

The invention, briefly, concerns a profile of contact surface of a gear rim of a rotor and/or stator of a rotary machine, having no less than one pair of gear rims—inner and outer, interacting with each other with creation of variable volume chambers, eccentrically located one inside the other with eccentricity e equal to the difference of the interacting surface radiuses. The claimed machine can have one pair of gear rims, interacting with each other with creation of variable volume chambers or several such pairs.

The profile of contact surface of inner and outer gear rim has an axis of symmetry, bounded by conjugated arcs and represents closed smooth curve, consisting of n>2 identical parts, conjugated among themselves. Identical part of the inner gear rim is bounded by the arc of radius $p_1$, conjugated at its ends with the arcs of radius $q_1$ and of radius $a+p_1$, where $a=p_1+q_1$. Arc of radius $q_1$ conjugated at the other end with the arc of radius $b+q_1$, where length b>0. Arc of radius $b+q_1$ is conjugated at the other end with the arc of radius a+p1 of adjacent identical part, which completes the gear rim profile.

Identical part of the outer gear rim is bounded by the arc of radius $p_2=p_1+e$, conjugated at its ends with the arcs of radius $q_2=a-p_2$ and of radius $a+p_2$. Arc of radius $q_2$ conjugated at the other end with the arc of radius $b+q_2$, which is conjugated at the other end with the arc of radius $a+p_2$ of adjacent identical part, which completes the gear rim profile.

From the said above it follows, that center of arcs of radius $p_1$ and $p_2$ is arbitrary placed at the distance a>0 from the center of arcs of radiuses $q_1$, $a+p_1$, $q_2$, $a+p_2$. The center of arcs of radiuses $b+q_1$ и $b+q_2$ is placed at the distances b>0 and b+2a from the center of arcs of radiuses $q_1$, $a+p_1$, $q_2$, $a+p_2$ given and adjacent identical parts.

Within the inner gear rim slide-valve is placed. This slide-valve contains spool valve and slide-valve ports, at that slide-valve ports have exit into contact surface of the inner gear rim in the part of its profile of the radius $b+q_1$.

Partition of the working surface profile into identical elements is a particular way of describing the profile. This invention defends the form of the profile of the rotor, bounded by conjugated arcs in a given order independently from grouping identical elements and without it.

The invention defends the profile of contact surface of a gear rim of the rotary machine, which provides for the creation of two types of chambers of variable volume. Achieving—more than a double distinction between volumes of processes, carried out in the machine,—expansion and compression, and only at the expense of the profile of contact surface of a gear rim. At the same time, the increase of specific productivity and yield of the rotary machine, both inner and outer gear rims are characterized by a uniform technique of construction; that considerably simplifies design, and manufacturing of rotors.

The invention defends the profile of contact surface of a gear rim of the rotary machine, with identical parts constructed from four conjugated arcs that provide effective work of a control gear placed within the inner rotor.

DRAWING FIGURES

FIG. 1. Pair of gear rims at n=7. General view.

Figure 2:
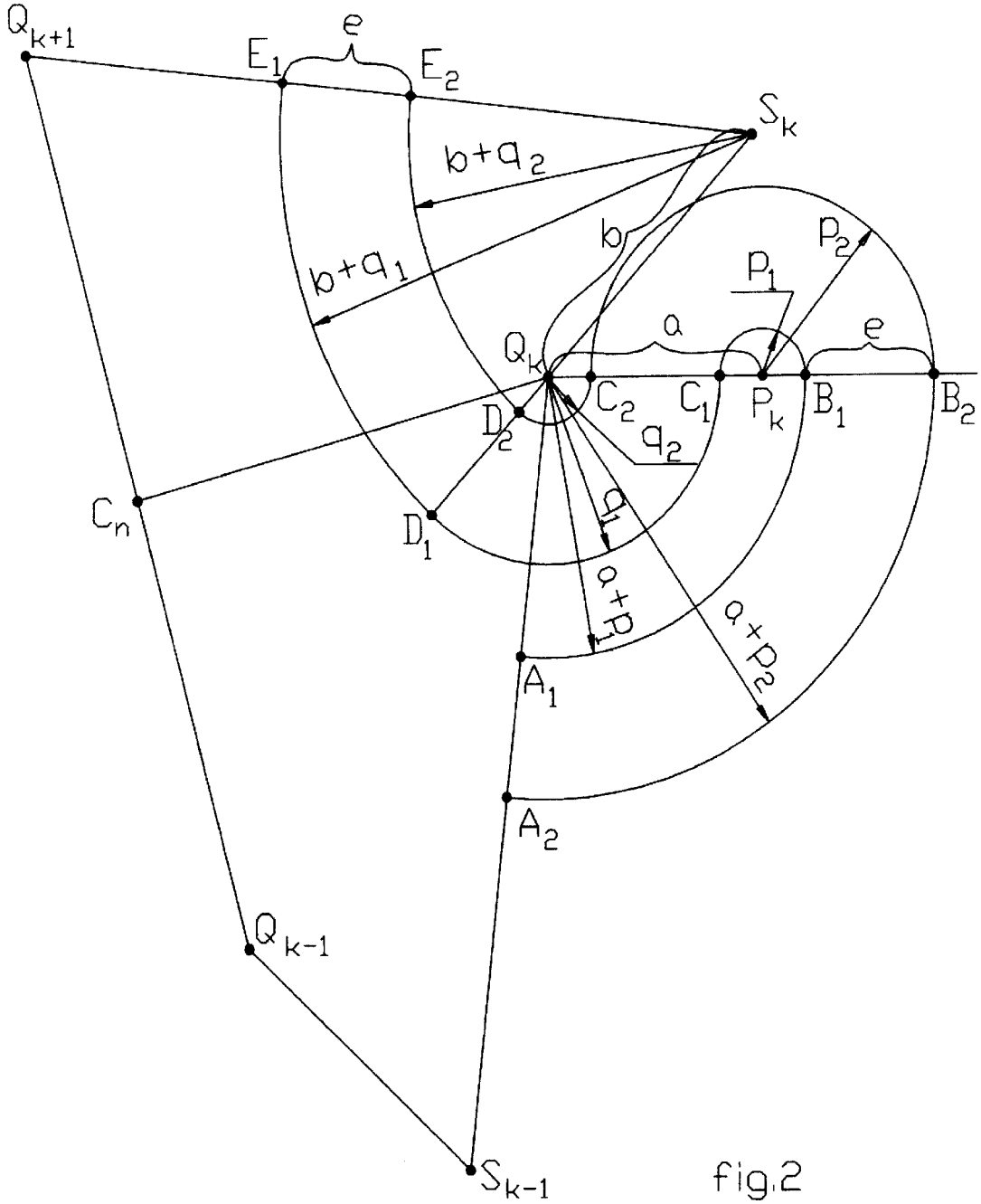

FIG. 2. Construction of an identical part of a profile of contact surface of pair of gear rims; generic case; n=4.

Figure 3:
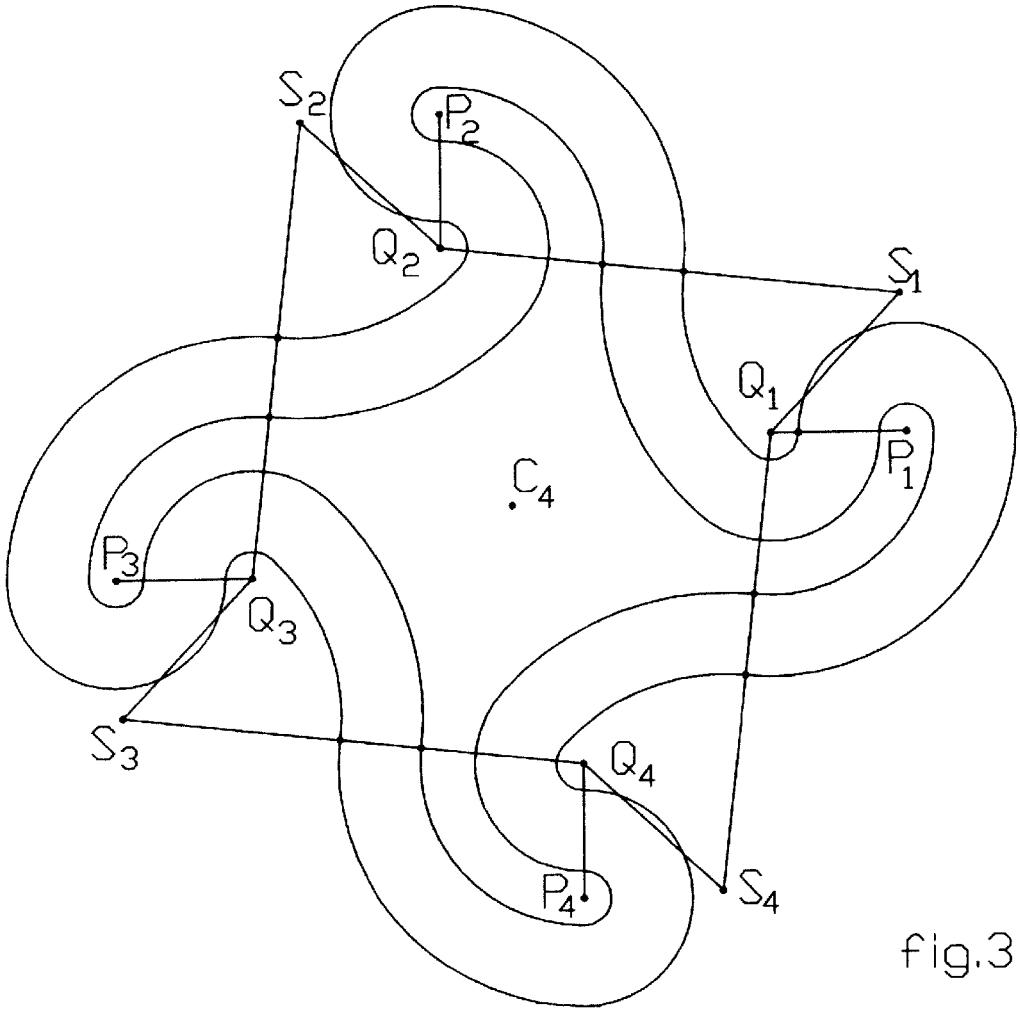

FIG. 3. Construction from identical parts of full profile of contact surface of pair of gear rims; generic case; n=4.

Figure 4:
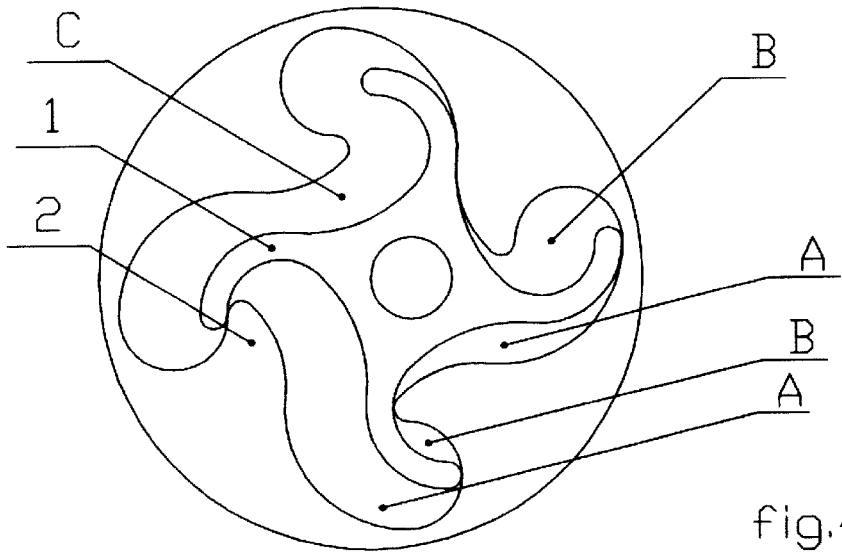

FIG. 4. Working relative placement of a pair of interconnected gear rims; generic case; n=4.

FIGS. 5 *a–d*. Disk version of rotors with two pairs of gear rims.

FIGS. 6 *a–b*. A schematic example of possible design of the machine.

FIGS. 7 *a–b*. A schematic example of possible design of the machine using parts of working surface with arcs of radius $b+q_1$ for placing in it slide-valve ports.

DETAILED DESCRIPTION OF THE DRAWINGS

FIG. 1. General view of the pair of gear rims is given at n=7. Pair of gear rim consists of an inner gear rim 1 and outer gear rim 2.

FIG. 2 illustrates identical part k, $k\epsilon[1,n]$, of a declared profile of contact surface of both inner and outer gear rims of the rotary machine.

Each gear rim contact surface profile is bounded by arcs with center points $P_k$ arcs of radiuses $p_1$ and $p_2$, $Q_k$ arcs of radiuses $q_1$, $a+p_1$, $q_2$, $a+p_2$ and $S_k$ arcs of radiuses $b+q_1$ $b+q_2$, $k\epsilon[1,n]$.

и The centers $P_k$ are arbitrary located at distance a from centers $Q_k$, that is they can be located on circles of radius a with the centers $Q_k$. The location of the centers $P_k$ relative to centers $Q_k$ defines a slope of rim teeth. Center $S_k$ is located at a distance b>0 from the center $Q_k$ and at a distance b+2a from the center $Q_{k+1}$ of adjacent an identical part k+1. The concrete location of centers $S_k$ relative to centers $Q_k$ defines ratio of volumes of expansion and compression processes, which are carried out in the machine. On FIGS. 2–4 the numbering of identical parts of a rim is accepted in a counter-clockwise direction, that defines a direction of a slope of gear rim teeth. At change of direction of numbering of identical parts of a rim, the direction of teeth slope of a gear rim will change.

Profile of an identical part k of a contact surface of inner gear rim is limited by an arc $C_1$ $B_1$ of a radius $p_1$ with the center $P_k$, conjugated by one end in a point $C_1$ with an arc $C_1$ $D_1$ of a radius $q_1=a-p_1$ with the center in $Q_k$ and at the other end in a point $B_1$ with an arc $A_1B_1$ of a radius $a+p_1$ with the center $Q_k$ The arc $C_1$ $D_1$ is conjugated in a point $D_1$ with an arc $D_1$ $E_1$ of a radius $b+q_1$ with the center $S_k$. From a condition of limitation of a profile of contact surface by conjugated arcs of circles, follows, that adjacent asymmetrical parts of rim profile are conjugated among themselves, that is the arc $D_1$ $E_1$, limiting an identical part k of a profile of contact surface of an inner gear rim, in a point $E_1$ is conjugated to an arc $A_1$ $B_1$ adjacent identical part k+1 of a profile in a point $A_1$. That is two circles of radiuses $b+q_1$ and $a+p_1$ with centers in $S_k$ and $Q_{k+1}$ are conjugated and also two circles of radiuses $a+p_1$ and $b+q_1$ with centers in $Q_k$ and $S_{k-1}$ are conjugated, where $Q_{k+1}$ and $S_{k-1}$—centers of arcs with radiuses $a+p_1$ and $b+q_1$ of adjacent identical part k+1 and k−1 respectively.

Since the conjugation of two arcs occurs in a point on their centerline, the distance between centers $S_k$ and $Q_{k+1}$, and also centers $Q_k$ and $S_{k-1}$ is equal $(b+q_1)+(a+p_1)=b+2a$.

From FIG. 2 it is clear, that part of profile limited by the arc $D_1$ $E_1$ of radius $b+q_1$ with center $S_k$ contains a conjugated part placed closest to the axes with order of symmetry $n-C_n$ and is ideally suited for placing in it slide-valve port.

Profile of an identical part k of a contact surface of outer gear rim is limited by an arc $C_2$ $B_2$ of a radius $p_2$ with the center $P_k$, conjugated by one end in a point $C_2$ with an arc $C_2$ $D_2$ of a radius $q_2=a-p_2$ with the center in $Q_k$ and at the other end in a point $B_2$ with an arc $A_2$ $B_2$ of a radius $a+p_2$ with the center $Q_k$, concentrical to an arc $C_2$ $D_2$ The arc $C_2$ $D_2$ is conjugated in a point $D_2$ with an arc $D_2$ $E_2$ of a radius $b+q_2$ with the center $S_k$. From a condition of limitation of a profile of contact surface by conjugated arcs of circles, follows, that adjacent asymmetrical parts of rim profile are conjugated among themselves, that is the arc $D_2$ $E_2$, limiting an identical part k of a profile of contact surface of an outer gear rim, in a point $E_2$ is conjugated to an arc $A_2$ $B_2$ adjacent identical part k+1 of a profile in a point $A_2$. That is two circles of radiuses $b+q_2$ and $a+p_2$ with centers in $S_k$ and $Q_{k+1}$ are conjugated and also two circles of radiuses $a+p_2$ and $b+q_2$ with centers in $Q_k$ and $S_{k-1}$ are conjugated, where $Q_{k+1}$ and $S_{k-1}$—centers of arcs with radiuses $a+p_2$ and $b+q_2$ of adjacent identical part k+1 and k−1 respectively. Since the conjugation of two arcs occurs in a point on their centerline, the distance between centers $S_k$ and $Q_{k+1}$, and also centers $Q_k$ and $S_{k-1}$ is equal $(b+q_2)+(a+p_2)=b+2a$.

FIG. 3 illustrates the construction from identical parts of a contact surface of pair of gear rims in the generic case while n=4.

Pair of profiles has an axis of symmetry of the fourth order $C_4$. Each contact surface profile of a gear rim consists of four identical parts, conjugated in their boundary points. For illustration purposes, the points of inner and outer rims with identical indexes are connected by segments, dividing pairwise identical parts of a pair of gear rims. The centers of all arcs, that limit profiles of both inner and outer gear rims, for an identical part k are located in points $P_k$, $Q_k$ and $S_k$ $k\epsilon[\mathbf{1},\mathbf{4}]$.

FIG. 4 illustrate a working condition of interaction of an inner rim 1 and outer rim 2, which are located with relative eccentricity $e=|p\mathbf{2}-p\mathbf{1}|=q\mathbf{1}-q\mathbf{2}|$. On both sides of a tooth of the gear rim two types of variable volume chambers are created: A and B. Simply connected region, where gear rims are not interacting, is the chamber of variable volume C.

Chambers of the type A or B, in which expansion process takes place, after reaching it's maximal volume, they break up and unite with chamber C. Chambers of the type A or B, in which compression process takes place, are created in their maximal volume as a result of closing portion of space of chamber C.

The maximal values of volumes vary. The ratio of this variance, for a concrete working process, is set at the design stage of the machine. So, the maximal volume of chambers of type A and B, on FIG. 4 have a ratio of distinction 2.65.

On FIG. 4 it is evidently visible, that the maximal volume of the chamber of type A surpasses the maximal volume of the chamber of type B which provides increase of yield of the machine or specific capacity, depending on a concrete working process.

After setting macro parameters e, a, b and interposition of centers $P_k$, $Q_k$ and $S_k$ the volume of chambers is singularly defined as a function of rotation angle of the rotors and does not depend on redistribution of values of radiuses p1, p2, q1, q2. It means that when macro parameters are set, thermodynamics, technical and volume characteristics of the machine become full invariants relative to the task of its macro parameters.

FIGS. 5, *a–d*. Rotors of disk version, as an illustration of use in the rotary machine more than one pair of gear rims.

The rotors (7 and 8) contain two pairs of gear rims. The rotor (7) mounted on the shaft (11), contains an inner gear rim (3) of internal pair and outer rim (6) of external pair of gear rims, mounted on the hub plate (9). The rotor (8) mounted on the shaft (12), contains combined by the non-working surfaces an outer rim (4) of internal pair of gear rims and inner rim (5) of external pair of gear rims, mounted on the hub plate (10). The gear rims (4 and 5) can be executed as one whole. The rotors (7 and 8) are mounted on shafts (11 and 12) with eccentricity e.

Characteristic length a can differ for different pairs of gear rims. Two pairs of gear rims on rotors of disk version can, for example, be used both as the twostage compressor, and as the turbocompressor engine. In case of the twostage compressor external pair of gear rims (5 and 6) is used as the first stage of the compressor, while an internal pair of gear rims (3 and 4)—as the second stage of the compressor. In case of the turbocompressor engine internal pair of gear rims (3 and 4) is used as compressor, and outer pair of gear rims (5 and 6) is used as turbine—expander.

Figure 6A:
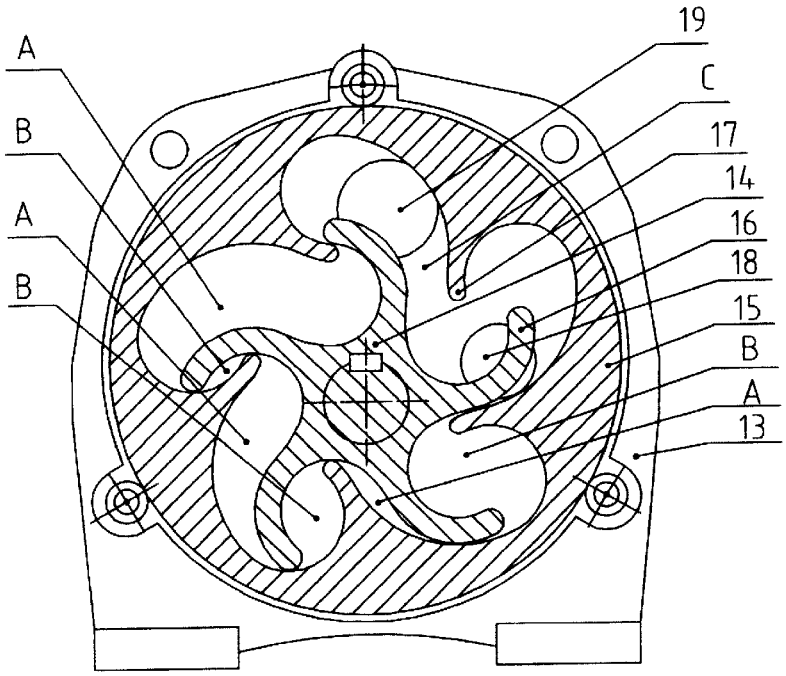
Figure 6B:
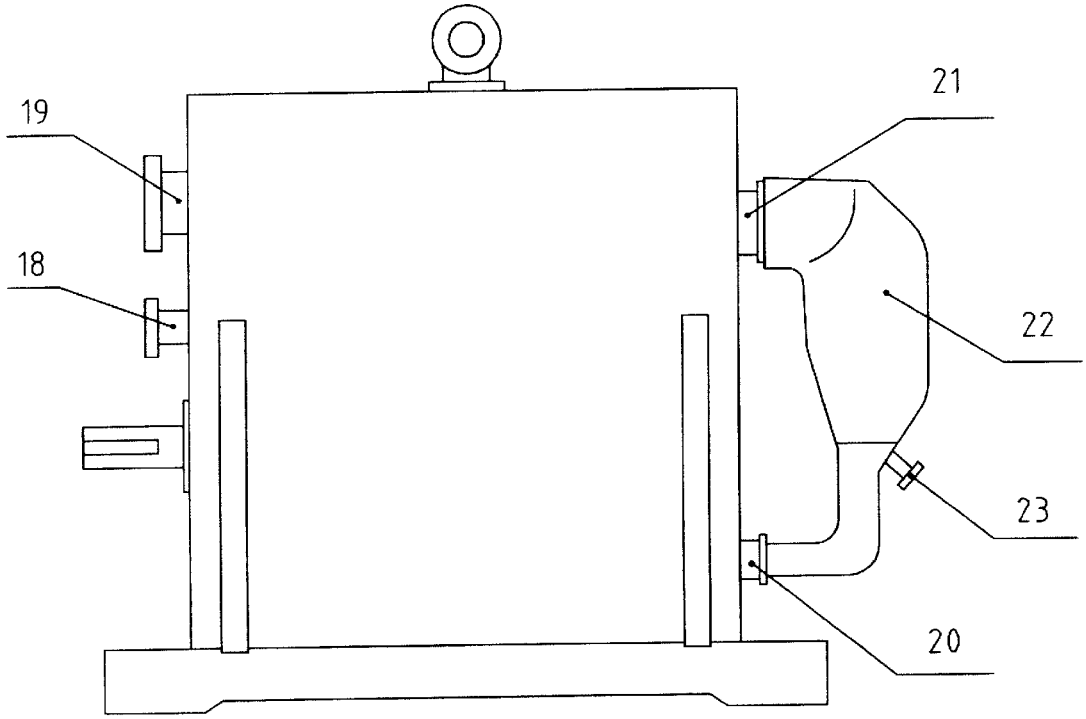

FIGS. 6*a–b*. An example of use of the invention in the machine used as the engine of external combustion, working on the extended indicator diagram, or as the single step compressor with an effect of a multistage compressor.

FIG. 6*a* schematically illustrates machine containing a case (13) in which the outer rotor (15) with coaxial gear rim (17) is mounted. Profile of a contact surface of gear rim (17) consists from n identical parts described on FIG. 2.

Inside a rotor (15), with eccentricity e the inner rotor (14) with coaxial gear rim (16) is mounted. Profile of a contact surface of gear rim (16) consists of n identical parts described on FIG. 2.

The rotors are designed and mounted one relative the other according to FIGS. 3,4. The rotors are mounted with a possibility of synchronized rotation in one direction with identical speed. At rotation of rotors the contact surfaces of gear rims interacting among themselves, in such a way that the operating space within a pair of interacting gear rims is split in the area of interaction of gear rims into closed chambers of variable volume of two types—type A and type B. Area of operating space inside a pair of gear rims, in which the operating surfaces of rims do not interact, is a chamber of variable volume of the third type C.

In a process of mutual displacement of the patches of interacting surfaces of gear rims, chambers type A and type B change in opposite way and stop their existence with the termination of interaction of the patches of interacting surfaces of gear rims.

The opposite change of volume of chambers type A and type B means, that at the moment of a beginning of interaction of patches, of interacting surfaces of gear rims, closing chambers, one of chambers, for example, type A, has it's possible maximal volume, and the chamber, type B, has it's possible minimal volume. During rotation of gear rims occurs displacement of lines of interaction of their working surfaces and, as result, redistribution of volumes between chambers A, B and C. Thus is volume of the chamber type A, formed with initial maximal volume, continuously decreases to the minimal volume at which chamber disappears, while volume of the chamber type B, formed with initial minimal volume is continuously increases up to the maximal volume at which occurs its opening and merging with chamber C. As simultaneously there is an interaction of several pairs of teeth of gear rims, several processes are simultaneously carried out that are distinguished only by phases.

Chamber C is simply connected region of space and working medium can freely flow into any part of this region. Particular feature of claimed pair of gear rims is the opportunity of the task of a required ratio between the maximal volumes of chambers of type A and of type B, in the process of designing the rotary machine.

In the case of the machine there are four channels (18, 19,20,21), connecting chambers of the machine by means of designated connecting devices, marked by the same numbers (18,19,20,21), with entrance and exit feeds and/or by devices with the possibility of capping unused channels.

The connecting device (18) connects through the channel (18) external feeds with region of chamber C, in which there is a creation of chambers type B in their greatest volume.

The connecting device (19) connects through the channel (19) external feeds with region of chamber C, in which there is an opening of chambers type A in their greatest volume, and their merging with chamber C.

The connecting device (20) connects through the channel (20) external feeds to chambers of type B.

The connecting device (21) connects through the channel (21) external feeds to chambers of type A.

For the machine to function as the external combustion engine, the channel (20) through the connecting device (20) is connected with an input device, and the channel (21) through the connecting device (21) is connected with the output device of the combustion chamber (22), containing also a channel for fuel injection (23).

Design of the combustion chamber (22), the communications of channels (18,19,20,21) with chambers of variable volume and with interchamber space are carried out by various known ways and thereof are marked schematically. Through the channel (18) takes place the purge by fresh air of the chamber type B at the phase of its formation (at this phase its volume is maximal). The purge by fresh air of chambers type B stops after their formation. At the further rotation of rotors of the machine, after achieving a certain degree of compression, compressed air from chambers type B through channel (20) is fed into the combustion chamber (22), where it is mixed with injected through the channel (23) fuel and where combustion accurse.

The turned out working medium through the channel (21) is fed into chambers type A at the initial phases of their expansion. At the certain phase of expansion of chambers type A, the feed of a working medium into them stops, and the further expansion occurs only at the expense of internal energy of a working medium. After achievement by chambers type A of maximal volume, they are disconnected, merging with the chamber C, then the exhausted working medium through channel (19) is directed to an exit feed.

As volume of chambers type A is grater than volume of chambers type B, the extraction of energy of a working medium in the considered scheme on value $\Delta P \times \Delta V$ ($\Delta V$–difference of volumes of chambers type A and B, $\Delta P$–average pressure on phases of expansion in oversize volume of chambers type A) is grater, than in known machines with equal volumes of compression and expansion.

The machine can function as the multistage compressor. For this purpose channels (18) and (19) capped, the channel (21) is switched by means of a connecting device (21) with an input feed, and the channel (20) is switched by means of the connecting device (20) with a output feed. The effect of a multistage compression is possible because through the channel (21) occurs sucking in of gas into chambers type A, after which break the gas gets into chamber C, carrying out a role of a receiver. From the chamber C gas through chambers type B, formed by closing of partial volume of the chamber C, is displaced through the channel (20) into an output feed. Since volume of chambers type A is grater than volume of chambers type B, therefor the volume of gas entering into chamber C through chamber type A is grater than the volume of gas exiting through chambers type B. It results in increase up to an equilibrium condition of pressure in the chamber C, that is chamber C acts as a preliminary stage of compressor.

Figure 7A:
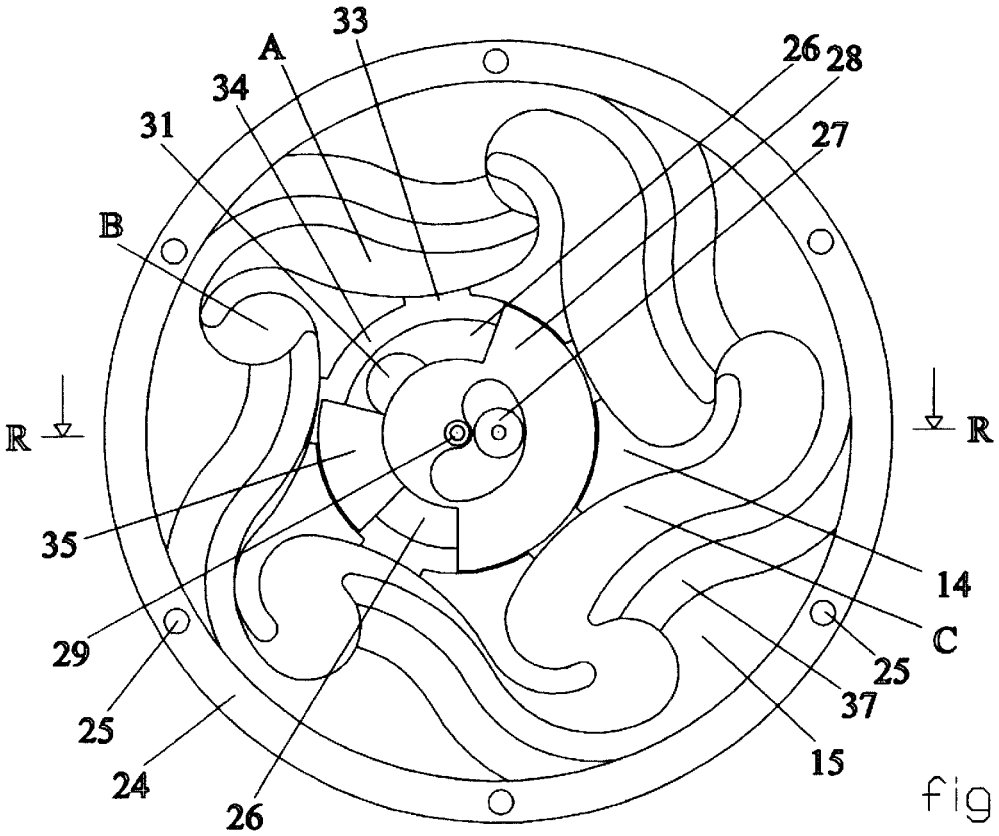
Figure 7B:
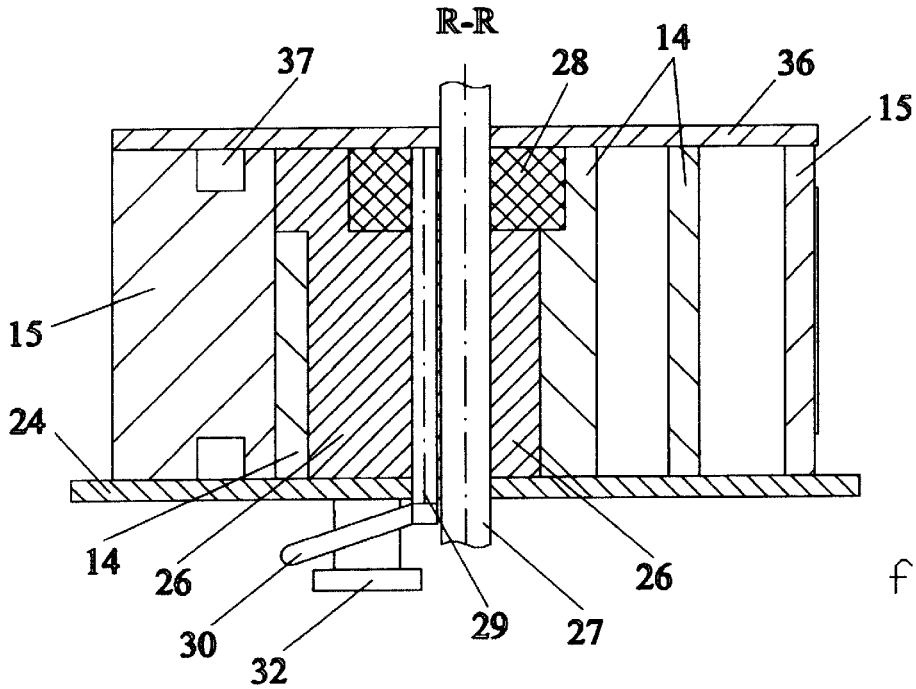

FIGS. 7*a–b*. A schematic example of possible design of the machine using parts of working surface with arcs of radius $b+q_1$ for placing in it slide-valve ports.

On FIGS. 7*a–b* there is a schematic representation of machine without casing that contains a base (24) with fastening openings (25) on which the base element (26) is rigidly fixed. Base element 26 is intended for placing of inner rotor (14), shaft (27) of outer rotor (15), slide-valve control gear that contains spool valve (28) placed on shaft (29) with the possibility of adjustment by means of handle (30). Base element (26) also contains a channel (31) that is connecting inlet or outlet pathway (not shown) with slide-valve control gear by means of branch pipe (32). Inner rotor (14) placed concentrically on base element (26) with the possibility of free rotation. Inner rotor (14) in the zone of slide-valve control gear has a ring shaped hollow (34) in which spool valve (28) is placed, and restricting lobe (35) of base element (26) that ensures isolation of the area where the working process is taking place (chambers type A) from adjacent areas (chambers type C) within the machine. Within the inner rotor (14) slide-valve ports (33) are placed, they have a depth of the ring hollow (34) and an exit into the external cylindrical surface of the rotor in the zone of working surface of the radius $b+q_1$. The section of these ports is very large, while the volume they require is so small, that it does not have any negative effect on the working process taking place in the machine. Outer rotor (15) concentrically fixed on the end cap (36), placed on the shaft f the machine (27). The function of the second end cap is performed by the base (24). Outer rotor (15) contains channels (37) for neutralization adjustment of volume of chambers type B unused in the working process. These channels (37) are also used for removing the used working media when the machine is working as a motor, and used for input of working media when the machine is working as a compressor.

The machine works as a compressor in the following way. Shaft (27) revolves anticlockwise from the external energy source. Together with the shaft outer rotor (15) is also rotating, as a result of the interaction of gear rims the inner rotor (14) is synchronically rotating too. As result of interaction of gear rims of rotors (14) and (15) chambers of variable volume are created. At that chambers of type A are created with maximal volume with following decrease of the volume to zero during the changing phases of rotation. For the maximal values of chambers volumes ports (33) in the cylindrical surface of the inner rotor (14) are closed by spool valve 28. After rotating at an angle, defined by the placement of spool valve (28), ports (33) open and compressed gas, the pressure of which is defined by placement of spool valve (28), is channeled through channel (31) into the exit outlet (not shown) of the machine. Compression ratio is adjusted by means of rotating spool valve (28) with handle (30).

The machine works as a motor in the following way. Compressed gas from an inlet channel (not shown) connected to the branch pipe (32) is supplied into channel (31), from where through ports (33) (in the cylindrical surface of the inner rotor (14)) it fills at a constant pressure chambers of type A, at phases where the volume of chambers varies from zero to the value defined by the position of the spool valve (28). Under the influence of pressure on rotor system pressure forces are applied in such a way that the rotors are revolving clockwise. After chamber A passes the phase where it is connected with channel (31) through port (33) within the cylindrical surface of inner rotor 14, the supply of pressured gas is terminated and the following expansion is taking place under the influence of inner forces. Changing the placement of spool valve (28), by means of shifting handle (30), it is possible to adjust power settings from maximal yield to maximal power.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

I claim:

1. Pair of interacting gear rims of the rotary machine including no less than one said pair of gear rims interacting with each other with creation of variable volume chambers, eccentrically located one inside the other with eccentricity e equal to the difference of the interacting surface radiuses;

profile of contact surface of inner and outer gear rim has an axis of symmetry, bounded by conjugated arcs, and consisting of $n>2$ identical parts, conjugated among themselves;

said identical part of the said inner gear rim is bounded by the arc of radius $p_1$, conjugated at its ends with the arcs of radius $q_1$ and of radius $a+p_1$, where $a=p_1+q_1$, said arc of radius $q_1$ conjugated at the other end with the arc of radius $b+q_1$, where $b>0$, which is conjugated at the other end with the said arc of radius $a+p_1$ of adjacent identical part, which completes the said gear rim profile;

said identical part of the said outer gear rim is bounded by the arc of radius $p_2=p_1+e$, conjugated at its ends with the arcs of radius $q_2=a-p_2$ and of radius $a+p_2$, said arc of radius $q_2$ conjugated at the other end with the arc of radius $b+q_2$, which is conjugated at the other end with the said arc of radius $a+p_2$ of adjacent identical part, which completes the said gear rim profile.

* * * * *